United States Patent [19]

Olsen et al.

[11] Patent Number: 4,747,362

[45] Date of Patent: May 31, 1988

[54] DOCK AND SWIMMING POOL DEVICE STOWABLE IN A SPACE IN A SHIP

[76] Inventors: Fred Olsen, Biskop Grinelunds vei 21, Oslo, Norway; Lennart Apelstrand, Apelsingatan 41, Västra Frölunda, Sweden

[21] Appl. No.: 21,250

[22] Filed: Mar. 3, 1987

[51] Int. Cl.[4] ..... A47K 3/00

[52] U.S. Cl. ..... 114/343; 4/487; 114/264

[58] Field of Search ..... 114/264, 343, 353, 354, 114/364; 4/487, 494, 495, 498, 500, 503

[56] References Cited

U.S. PATENT DOCUMENTS

| | | | |
|---|---|---|---|
| 1,583,127 | 5/1926 | Curtis | 4/487 |
| 2,013,635 | 9/1935 | Serafinowicz | 4/487 |
| 2,092,782 | 9/1937 | Serafinowicz | 4/487 |
| 3,026,538 | 3/1962 | Boyd et al. | 4/487 |
| 3,099,018 | 7/1963 | O'Connell | 4/487 |
| 4,236,259 | 12/1980 | Wendt | 4/498 |

FOREIGN PATENT DOCUMENTS

| | | | |
|---|---|---|---|
| 12867 | 9/1887 | United Kingdom | 4/487 |

*Primary Examiner*—Joseph F. Peters, Jr.
*Assistant Examiner*—Thomas J. Brahan
*Attorney, Agent, or Firm*—Holman & Stern, Chartered

[57] ABSTRACT

A dock and pool device stowable in a space in a ship comprises a collapsible pool portion (21) with a frame (24–27), which when erected stretches out nets, defining the bottom and four sides of the pool. The frame can consist of two rectangular frame sections (24) forming the longitudinal sides, two transverse frame sections (25) hinged to the longitudinal sides and forming the short sides, said sections each comprising two halves (25*a*) hingedly interconnected along a vertical joint at the longitudinal centerline, and a least two section halves (26) forming the bottom of the frame. These can be hinged together along or at a symmetrical distance from the longitudinal centerline of the pool and be hinged to the respective adjacent longitudinal side section (24). The frame has also hoist means by means of which the pool (21) can be hoisted off and into the ship and for erecting and collapsing the pool.

4 Claims, 6 Drawing Sheets

DOCK AND SWIMMING POOL DEVICE STOWABLE IN A SPACE IN A SHIP

Figure 1:
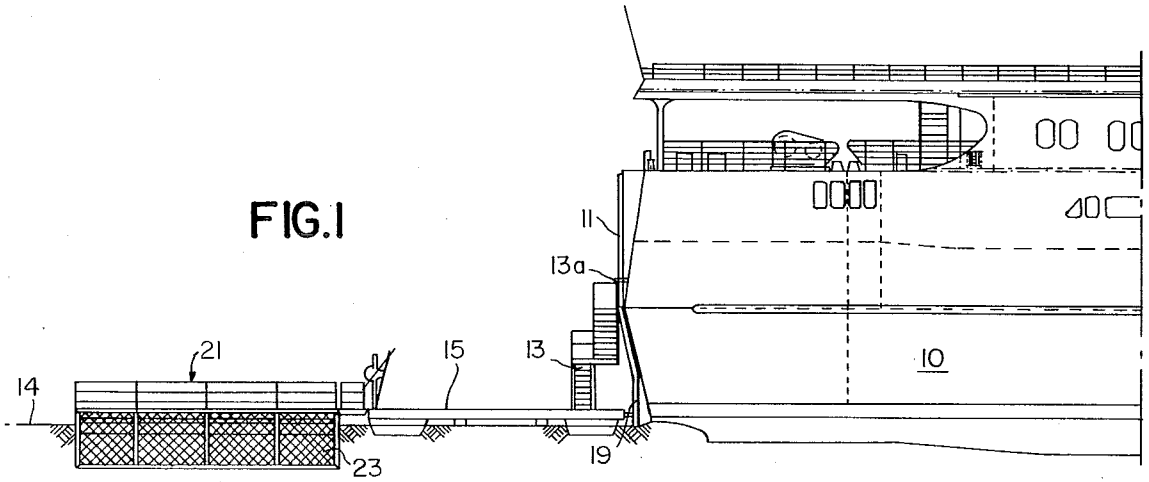

The present invention relates to a dock and swimmingpool device stowable in a space in a ship.

There is considerable interest in equipping cruise ships with a portable "swimming beach" which can be used for swimming and as a base for sailboards and other such equipment. A few ideas have been proposed, for example floating docks transported in davits at the stern of the ship. A disadvantage of this method of transport is that heavy winds and seas can damage the dock. It is of course conceivable that it could be lifted in over the after-deck and made fast there. This would be a considerable disadvantage, however, since the after-deck of a cruise ship is usually made as a wind-protected sunbathing area for the passengers.

It would thus be a great advantage if the device could be transported within the vessel and lifted out when the ship has anchored at a suitable location. One problem here is of course designing the device so that it takes up the least possible space when stowed and still is sufficiently large to be able to be used by a number of people when the device is in the water.

The purpose of the invention is therefore to achieve an easily launchable dock and swimmingpool device of the above-mentioned type which can be quickly stowed in a small protected space. For this purpose the invention is characterized by a collapsible pool portion with a frame which when erected stretches out nets, defining the bottom and four sides of the pool.

According to a preferred embodiment of the invention, the frame consists of two parallel, upright rectangular frame sections forming the two longitudinal sides of the frame; two transverse upright frame sections each comprising two halves hingedly interconnected along a vertical joint at the longitudinal centerline of the pool; and at least two section halves forming the bottom of the frame, which are flexibly joined along or at a symmetrical distance from said longitudinal centerline of the pool portion and are hinged to the respective adjacent longitudinal side section; and that the frame has hoist means, by means of which the pool can be lifted off and onto the vessel and can be erected and collapsed.

According to a further advantageous embodiment of the invention, the long side and short side sections of the frame are hollow tubular profiles to which bodies of buoyant material are attached.

Suitably the two halves of the bottom section are joined via a link section which is suitably provided with two blocks, over which the two ends of a hoisting wire extend so that each end of the hoisting wire is bent essentially horizontally and is fixed in the end of a connecting rod, which at said same end is guided in a groove in the link section and at the opposite end is joined to the common center hinge of the respective short side section halves.

Furthermore, each of the longitudinal sides is suitably provided with a cover pivotable along the upper edge, which when folded in completely covers the pool opening when the pool is in its collapsed state, and forms resting areas at the longitudinal sides of the pool when in the 180° opposite, erected position.

Figure 2:
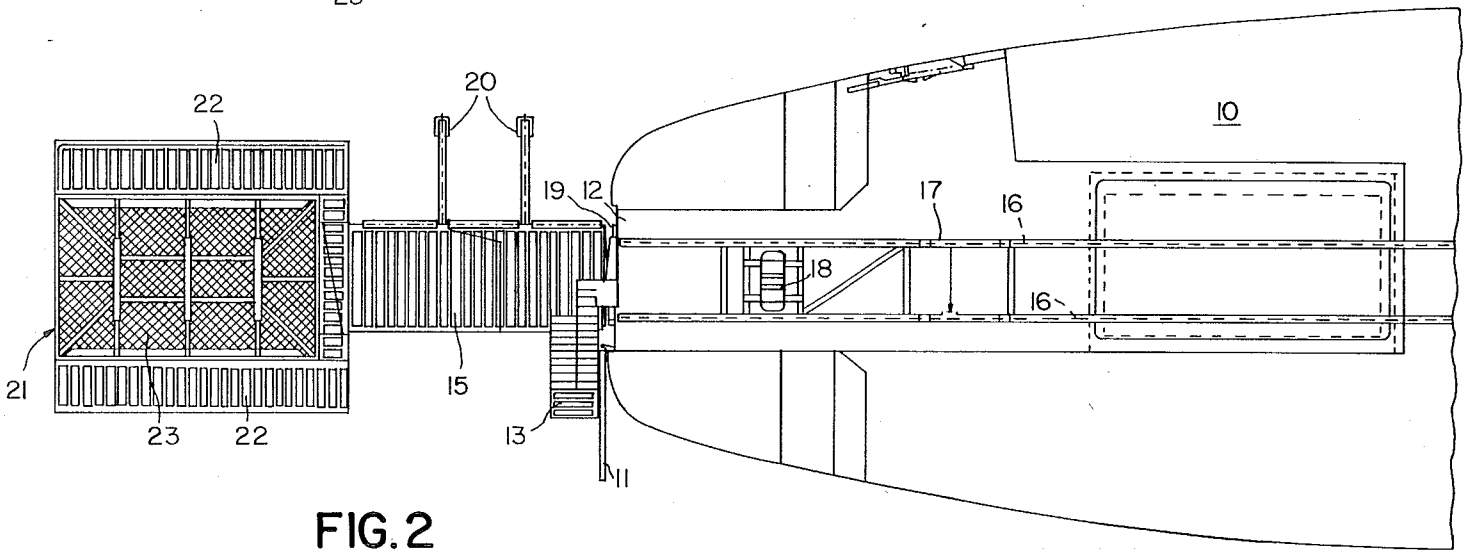
Figure 3:
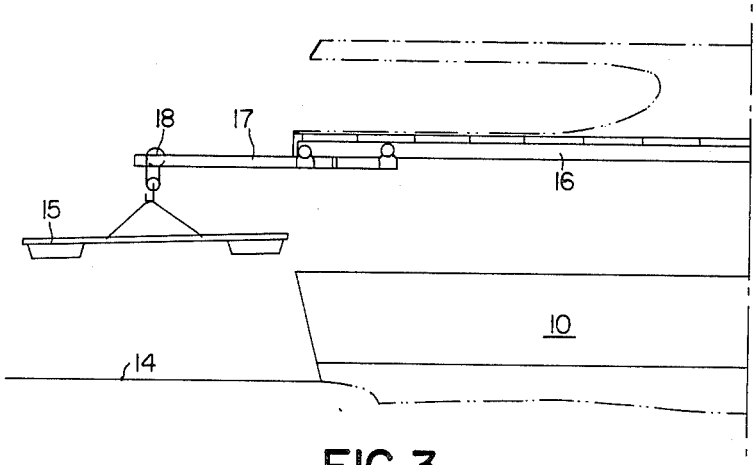
Figure 4:
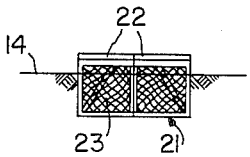
Figure 5:
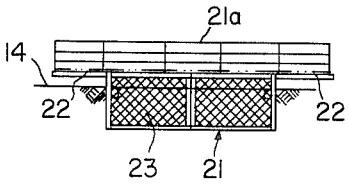
Figure 6:
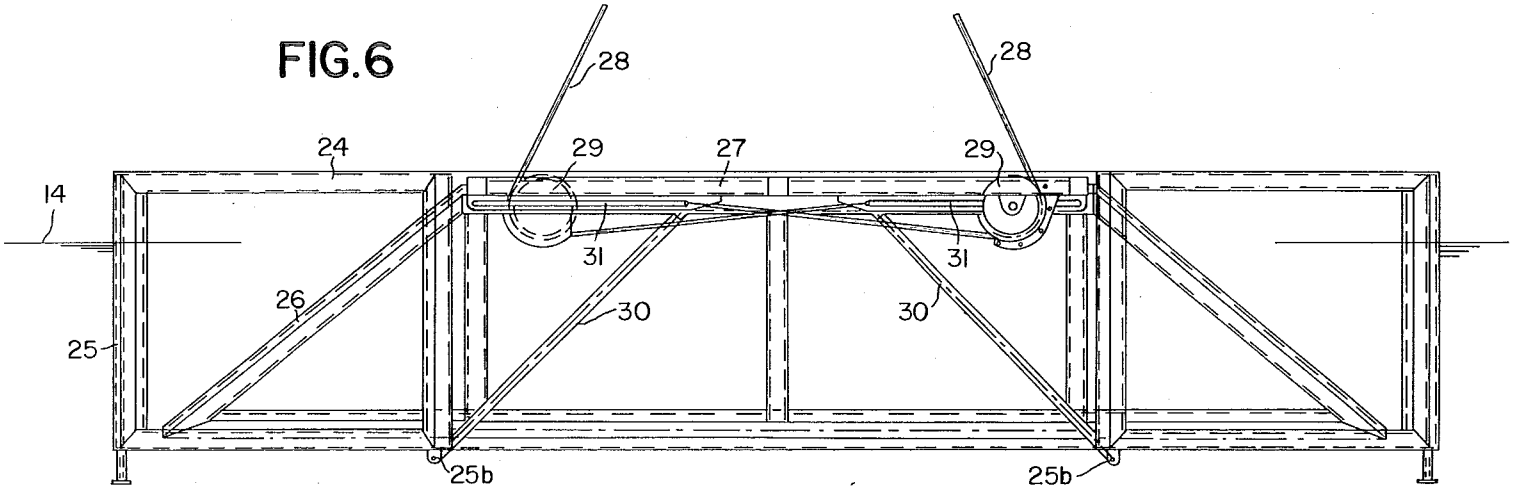
Figure 7:
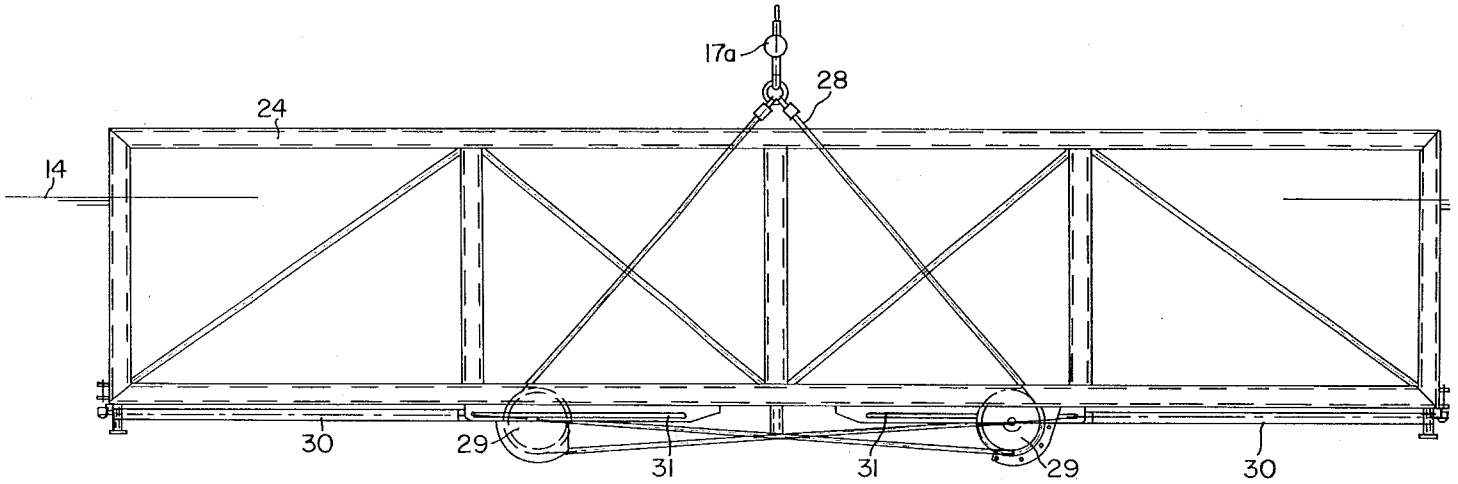
Figure 8:
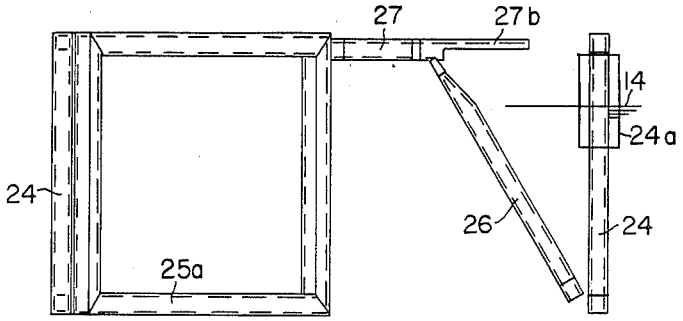
Figure 9:
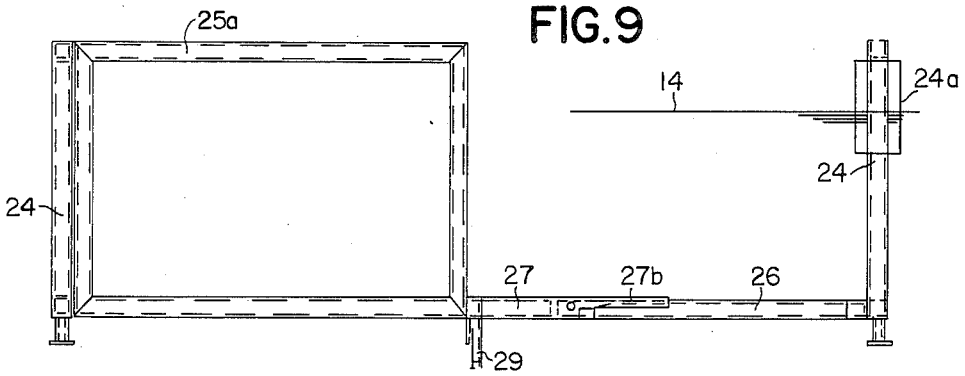
Figure 12:
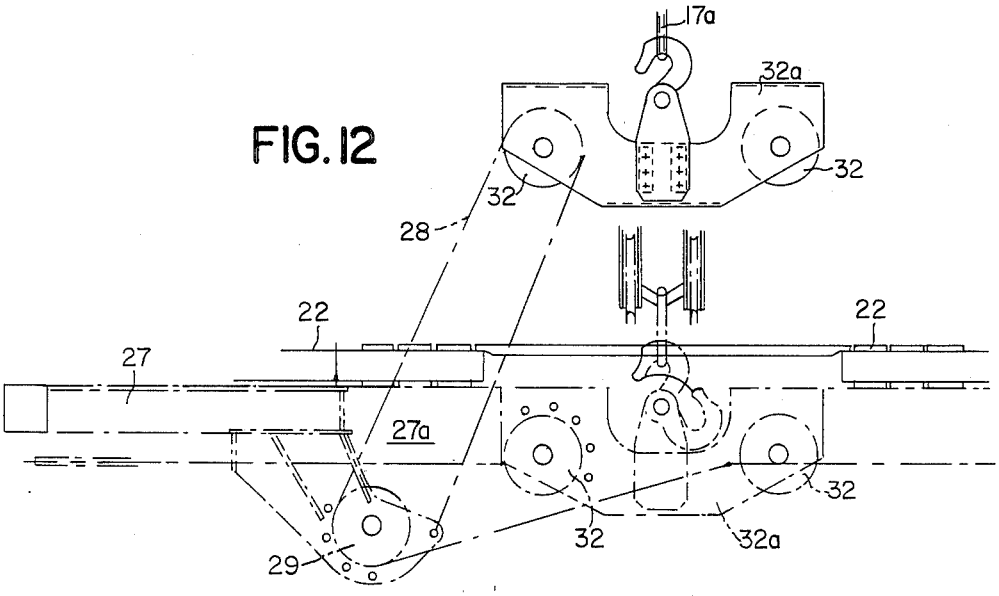
Figure 10:
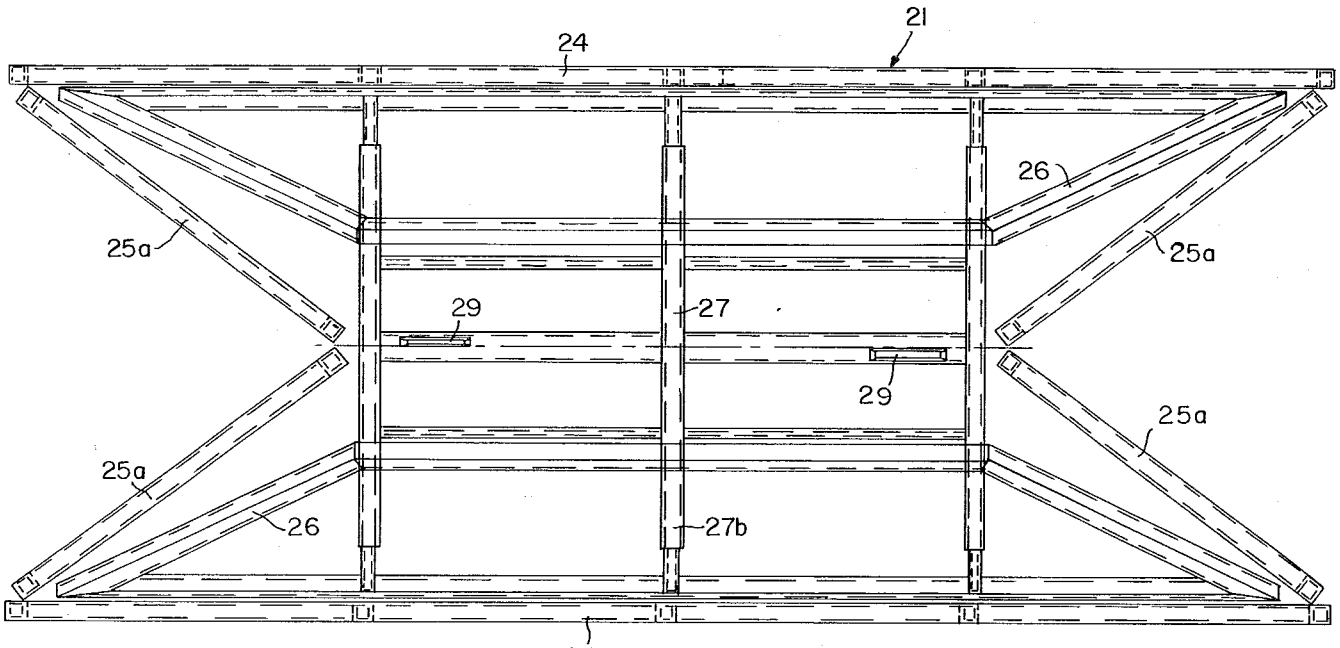
Figure 11:
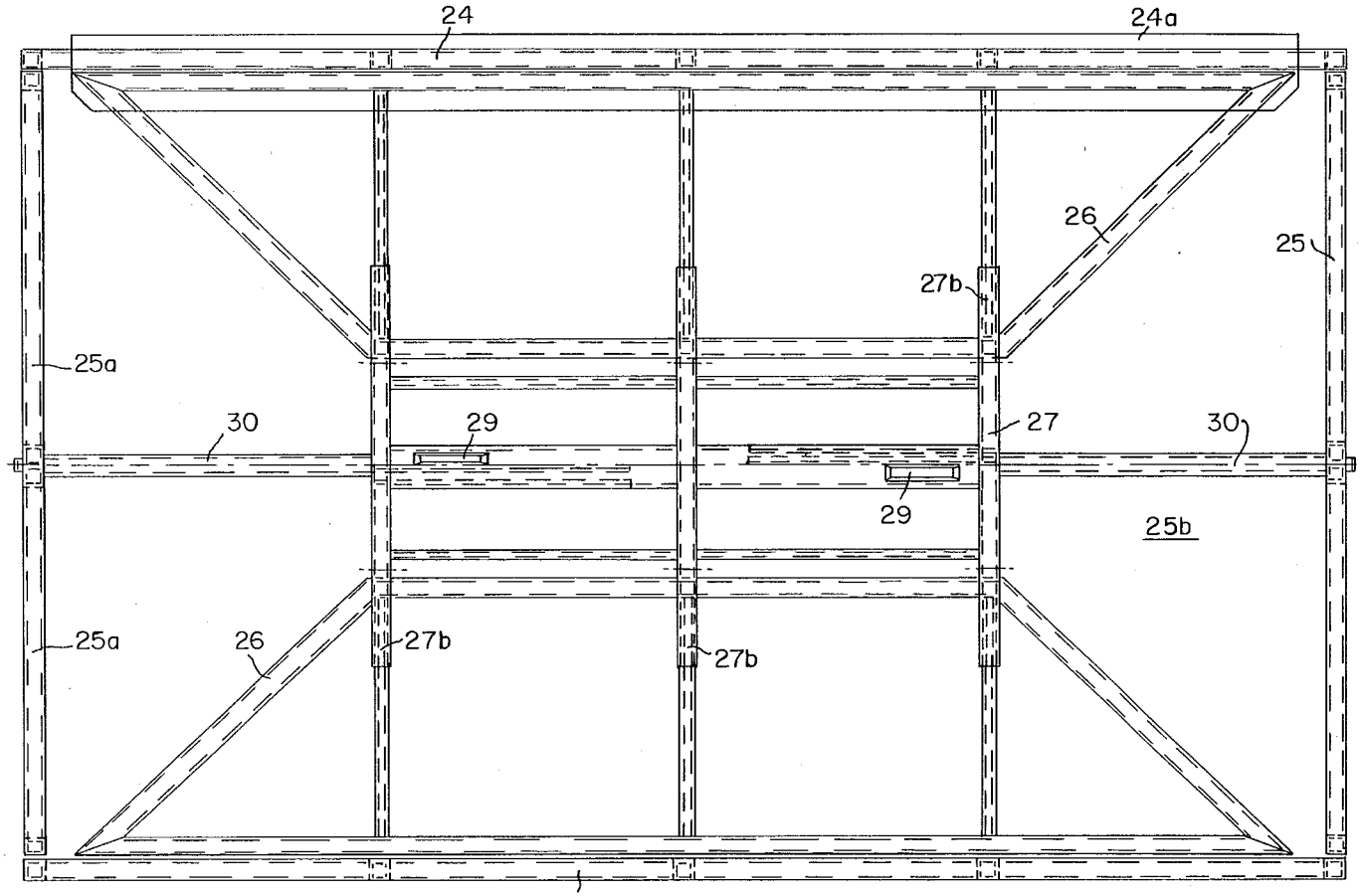

An embodiment of the invention will be described below in more detail with reference to the accompanying drawings, of which FIG. 1 is a side view of the stern of a cruise ship with a dock and pool device according to the invention, FIG. 2 is a plan view of the device and the stern of the vessel shown schematically in section, FIG. 3 shows schematically a side view of the stern in section with lifting equipment for handling the dock and pool device, FIG. 4 is an end view of the pool portion in the collapsed state, FIG. 5 is a corresponding view of the pool portion when erected, FIGS. 6 and 7 are side views on a larger scale of the pool portion in the collapsed and erected states, respectively, FIGS. 8 and 9 are end views partially in section of the frame on the same scale when collapsed and when erected, respectively, FIGS. 10 and 11 are plan views of the frame in the collapsed and erected states, respectively, and FIG. 12 shows on a still larger scale an alternative embodiment of the lifting means for handling the pool portion.

The cruise ship 10 shown in FIGS. 1 and 2 is provided with a stern hatch 11, which can be swung 180° about a vertical axis, thereby sealing or opening a rectangular opening 12 at the fore- and aft-line of the ship. The inside of the stern hatch 11 has a stairway 13 which can swing 180° about a horizontal axis 13*a* from a stowing position where the stairway in its entirety is within the external dimensions of the hatch and a position for use where the stairway extends down to a pontoon dock 15 floating on the surface of the water. It can be maneuvered by means of a travelling crane 17 which is movable along rails 16 in the ship and which has lifting machinery 18.

The inner end of the pontoon dock 15 can, in the position shown in FIG. 3, be guided down between guides 19 on the transom of the vessel 10, and this is done before the stairway 13 is pivoted to its position for use. The lower portion of the guides form flexible anchoring points for the pontoon dock 15, thus providing a floating platform securely anchored to the ship by merely lowering the dock in its guides 19. After swinging the stairway 13 to its position for use, easy access to the dock 15 is provided. As revealed in FIG. 2, the dock is provided with mooring booms 20, for rubber boats or other leisure craft. The booms are of common design and can be folded over the pontoon dock 15 when it is to be lifted into its stowing position.

The pool portion 21 is normally stowed on top of the pontoon 15 and is lifted out before it through the opening 12 and moored temporarily to one side of the stern of the ship, while the pontoon dock 15 is put in the water. FIG. 4 shows the pool portion launched in its collapsed position. In this position the pool portion has a flat top side and can be used as an extension of the pontoon dock 15. In its erected position, as shown in FIG. 5, covers 22, which in the collapsed position form the top side, have been swung out 180° to form resting areas at the two longsides of the pool. The pool itself consists of a pipe frame connected by joints, stretching out nets 23. In the embodiment shown, the width ratio is 2:3 between the collapsed and the erected frame. The upper edge of the frame and the covers 22 are provided along three sides with lifelines 21*a* supported by vertical stanchions.

FIGS. 6–11 show on a considerably larger scale the hinged sections of the frame. The frame consists of two parallel, upright rectangular frame sections 24 forming the longitudinal sides of the frame, two short side sections 25 connected to the ends of the longsides, each being divided vertically in the middle into two hinged halves 25*a*, two trapezoidal sections 26 forming the bottom of the frame, hinged to the lower edges of sections 24 and flexibly interconnected via a link section 27.

At least the two longitudinal side sections 24 are provided with bouyant bodies of cellular plastic material 24*a* as shown in 9 and 11 Figures. FIGS. 6–11 do not show the nets mounted on each frame section and between sections 25, 26 and 27.

On link sections 27 are mounted the means guiding the collapsing and erection of the frame. FIG. 7 shows a variant in which the lifting eye 17*a* of the travelling crane 17 is attached to a hoist arrangement 28 the wires of which run over blocks 29 and then run past each other essentially horizontally to the ends of the respective connecting rods 30. Said end is guided in a groove 31 in the link section 27 and the opposite end of each connecting rod 30 is connected to a lower joint 25*b*, which joins the two section halves 25*a*. When the pool portion 21 is hanging in the wires 28, the link section 27 is slightly below the plane defined by the upper edges of sections 24 and 25. In this state, the inner ends of the connecting rods 30 are closest to each other in the respective grooves 31, so that the two section halves 25*a* at either end of the pool portion assume a defined angular position. In this state, with the covers 22 swung inwards, the pool portion 21 can be lifted in or out through the stern hatch 11.

When the pool portion is lowered into the water, the longitudinal side sections 24 provide most of the buoyancy, while the bottom sections 26 and the link section 27 pull it down when the lifting force in the wires 28 ceases. The two sections 24 are then pressed apart in parallel at the same time as the two section halves 25*a* are folded out until the frame assumes a rectangular shape.

FIG. 12 shows a further development of the hoist arrangement 28, which has been provided with blocks 32 to provide a mechanical advantage when lifting. The block frame 32*a* can be dropped into a recess 27*a* in the link section so that no parts of the block holder extend above the top of the link section. As can be seen in FIG. 8, the link section 27 is provided with a projection 27*b*, which is designed to rest against the top of the beams in the bottom sections 26 so that they cannot be folded past a horizontal bottom plane.

The invention is not limited to the embodiment described above. Rather, a number of variations are conceivable within the scope of the following claims. For example, the lift means for handling the pool portion 21 and its erection and collapse can be designed in many different ways. The link section 27 is not necessary per se for the invention. Elastic means or springs can be used to press the connecting rods 30 outwards for example, so that folding out of the section halves 25*a* is facilitated.

We claim:

1. A collapsible pool, comprising:

a rectangular frame structure having, in an erected state of said pool, four upright sides and a bottom, said sides and bottom being covered with nets, said sides including:

two parallel longitudinal side sections each defined by upper and lower horizontal edge members and vertical edge members joining the ends of said upper and lower horizontal edge members; and two parallel transverse side sections each having two halves defined by upper and lower horizontal edge members and vertical edge members joining the ends of said upper and lower horizontal edge members, said halves of each side section being hingedly interconnected along a vertical axis joint joining meeting edges of respective vertical edge members thereof, whereby said transverse side sections are inwardly foldable along said vertical axis joints;

said bottom including two trapezoidal frame sections each defined by a long and a short parallel edge member and angular edge members interconnecting said long and short edge members, a link section hingedly interconnected to said short edge members of said trapezoidal frame sections, and flexible means for hingedly interconnecting said long edge members of said trapezoidal frame sections to respective ones of said lower horizontal edge members of said longitudinal side sections; and means for engaging a hoisting gear, said hoisting gear engaging means being located at a longitudinal centerline of said pool intermediate said longitudinal side sections.

2. A collapsible pool according to claim 1 wherein said hoisting gear engaging means includes two sheaves mounted at said link section and two wires running over said sheaves, each said wire having one end connected to a common lifting member while its opposite end is connected at the vertical axis joint interconnecting the halves of a transverse side section.

3. A collapsible pool according to claim 1 wherein said hoisting gear engaging means includes first and second sheaves mounted at said link section as well as a hoisting gear engaging frame member carrying third and fourth sheaves, and wherein a first wire has one end attached adjacent to said first sheave, said first wire running over said third sheave and back over said first sheave, said first wire having its other end attached to the vertical axis joint interconnecting the halves of one of said transverse side sections outside said second sheave, while a second wire has one end attached adjacent to said second sheave, said second wire running over said fourth sheave and back over said second sheave, said second wire having its other end attached to the vertical axis joint at the other transverse side section.

4. A collapsible pool according to claim 1, wherein each of the longitudinal side sections is provided with a cover pivotable along an upper edge of the upper horizontal edge member thereof, which cover when folded in completely covers the pool opening when the pool is in its collapsed state and which cover forms outwardly extending resting areas at the longitudinal sides of the pool when said cover is in the 180° opposite, outwardly unfolded position.

* * * * *